United States Patent [19]

Miwa et al.

[11] Patent Number: 4,505,785

[45] Date of Patent: Mar. 19, 1985

[54] METHOD FOR ELECTROPLATING STEEL STRIP

[75] Inventors: Hiroshi Miwa, Tokyo; Toshio Kaneko, Yokohama; Akira Tonouchi, Tokyo; Tatsuro Anan, Fukuyama, all of Japan

[73] Assignee: Nippon Kokan Kabushiki Kaisha, Tokyo, Japan

[21] Appl. No.: 349,681

[22] Filed: Feb. 17, 1982

[30] Foreign Application Priority Data

Feb. 24, 1981 [JP] Japan ..... 56-25920

[51] Int. Cl.[3] ..... C25D 7/06

[52] U.S. Cl. ..... 204/28; 204/206

[58] Field of Search ..... 204/28, 206–211, 204/286

[56] References Cited

U.S. PATENT DOCUMENTS

| | | | |
|---|---|---|---|
| 2,312,452 | 3/1943 | Taylerson | 204/206 |
| 2,399,254 | 4/1946 | Rieger et al. | 204/206 |
| 3,264,198 | 8/1966 | Wells | 204/28 |
| 3,468,783 | 9/1969 | Avellone | 204/207 |
| 3,691,049 | 9/1972 | Eppensteiner et al. | 204/206 |

FOREIGN PATENT DOCUMENTS

| | | |
|---|---|---|
| 2323788 | 3/1978 | Fed. Rep. of Germany . |
| 1595712 | 7/1970 | France . |

OTHER PUBLICATIONS pp. 84–87 of Japanese publication, "Tinplate and Tin--Free Steel".

*Primary Examiner*—G. L. Kaplan
*Assistant Examiner*—William Leader
*Attorney, Agent, or Firm*—Frishauf, Holtz, Goodman and Woodward

[57] ABSTRACT

Disclosed is a method for electroplating a steel strip by arranging a plurality of electrode rows each consisting of a plurality of electrodes disposed adjacent to each other along the direction of width of said steel strip in opposition to said strip travelling in an electrolytic cell holding an electrolytic solution, so that a metal constituting said electrodes may be electroplated on said steel strip, comprising the steps of intermittently or continuously transferring said electrodes of said electrode rows in a direction perpendicularly to the direction of travel of said steel strip at a speed so that a distribution of a deposition amount of the metal of said electrodes along the direction of width of said steel strip may be kept within an allowable tolerance, a width of said electrode rows being greater than the width of said steel strip; and unloading said electrode from one end of one of said electrode rows transferred by said transferring step and loading said electrode to the other end of said one electrode row or to an end of another of said electrode rows.

11 Claims, 23 Drawing Figures

METHOD FOR ELECTROPLATING STEEL STRIP

BACKGROUND OF THE INVENTION

The present invention relates to a method for electroplating a metal strip in a soluble anode system using zinc, tin or other metals as an electrode material.

According to the electroplating method of a steel strip in a soluble anode system, electrodes of a metal for electroplating are arranged in an electrolytic solution in opposition to one or both surfaces of a steel strip. A current is flown using the electrodes as an anode and the steel strip as a cathode, so that the metal of the electrodes may be deposited on the steel strip by electrolysis.

Apparatuses for practicing such electroplating method include those of horizontal type, vertical type and radial type.

In a horizontal type electroplating apparatus, as shown in FIGS. 1A and 1B, a plurality of electrode rows 2, each consisting of a plurality of electrodes arranged horizontally and perpendicularly to the direction of travel of a steel strip 1, are disposed below and above the steel strip 1 travelling horizontally within an electrolytic solution 4. Each electrode row is immersed in the electrolytic solution 4 and is connected to busbars 3.

To a vertical type electroplating apparatus, as shown in FIG. 2, electrode rows 2, each consisting of a plurality of electrodes arranged horizontally and perpendicularly to the direction of travel of the steel strip 1, are arranged at the input side and the output side of a sink roll 6 in opposition to both surfaces of the steel strip 1 which is transferred in a U-shaped form by vertically arranged conductor rolls 5 and the sink roll 6.

In a radial type electroplating apparatus, as shown in FIG. 3, two electrode rows 2, each consisting of a plurality of electrodes arranged perpendicularly to the direction of travel of the steel strip 1 are arranged in opposition to both surfaces of the steel strip 1 which is curved in an arc shape by a conductor roll 7.

In these horizontal type and vertical type electroplating apparatuses, the width of the electrode row 2 is set to be narrower than that of the steel strip 1 by a predetermined amount. This is for the purpose of avoiding the problems to be described below when the width of the electrode row 2 is greater than or excessively smaller than that of the steel strip 1.

When the width of the electrode row 2 is greater than that of the steel strip 1, problems (1) and (2) to be described below occur:

(1) As shown in FIG. 4A, the current from the electrodes 2 is concentrated at the edge portions of the steel strip 1, so that the metal film formed at these edge portions becomes thicker.

(2) As shown in FIG. 4B, since the thickness of only electrodes 8*a* opposed to the steel strip 1 decreases, it is impossible to keep the gap between the steel strip 1 and the electrodes constant (this is because the electrode rows cannot be brought closer to each other since electrodes 8*b* at the ends of the electrode row 2 contact each other). When this happens, the voltage must be increased, so that the power consumption increases.

On the other hand, if the width of the electrode row is excessively smaller than that of the steel strip, problem (3) to be described below occurs.

(3) As may be seen from the distribution of the deposition amount shown in FIG. 5, a metal deposited on the portions a little inside of both edges of the strip has a smaller amount than at the central portion of said strip. This results in irregular distribution of the deposition amount along the direction of width of the strip.

For the reasons (1), (2) and (3) described above, the width of the electrode row is conventionally adjusted according to changes in the strip width. According to the method for this adjustment, as the strip width decreases, the electrodes at the ends of the electrode rows are unloaded. However, this adjustment method presents following problems (4) to (7):

(4) The lower electrode row of the horizontal type apparatus and the electrode rows of the vertical type apparatus are respectively arranged below the steel strip and the conductor roll. Therefore, the accessibility for unloading the electrodes at the ends of the electrode rows for the purpose of decreasing the width of the electrode row is poor.

(5) The thickness of the individually unloaded electrodes is not so small as to justify disposal but is not uniform. If these electrodes are disposed, the use efficiency of the electrodes is degraded. On the other hand, if these electrodes are to be put to use again, they must first be stored in great quantity and must then be grouped into electrode rows of substantially the same thickness.

(6) As may be seen from the graph shown in FIG. 6, even if the width (line s) of the steel strip decreases linearly, the width (stepped line e) of the electrode row decreases in a stepped manner. Therefore, the difference between the width of the electrode row and that of the steel strip becomes maximum when the electrodes at the ends of the electrode row are unloaded. Then, the width of the electrode row becomes too small as compared with the strip width. This results in the nonuniformity of the deposition amount of the metal as shown in FIG. 5. In order to prevent this, the width of each electrode constituting the electrode row may be decreased. However, this results in a greater frequency of unloading of electrodes, which is not preferable.

(7) In the horizontal type apparatus, as shown in FIG. 7, the busbar 3 for energizing the electrode row 2 arranged below the steel strip 1 is in direct opposition with the steel strip 1 in the electrolytic solution. Therefore, the current flows from the busbar 3 to the steel strip 1, and the busbar 3 is electrolytically corroded. This electrolytic corrosion of the busbar 3 is notable when a chloride bath is used as an electrolytic solution.

Problems (4) to (7) described above may be solved by increasing the width of the electrode row in excess of the strip width. However, when this measure is taken, problems (1) and (2) as described above occur. In order to solve problem (1), a method is developed according to which an edge mask is arranged in the vicinity of the edge of the steel strip 1 in order to avoid the current concentration at the strip edge. However, even when this measure is taken, problem (2) still remain unsolved.

In order to solve problem (2), the electrode transfer method is known which is conventionally adopted in tin plating. According to this method of electroplating, as shown in FIGS. 8A and 8B, electrodes 8 of sequentially varied thicknesses are arranged on inclined busbars 3, so that a constant gap is kept between the steel strip 1 and the respective electrode 8. When the thickness of each electrode is decreased by a thickness corresponding to the thickness difference between the adjacent electrodes, the electrode row 2 is displaced in the direction indicated by the arrow for a distance corresponding to the width of one electrode. Then, the electrode of least thickness is unloaded from the left in the direction indicated by the arrow, and a new electrode is loaded from the right. According to this method, the gap between the electrodes 8 and the steel plate 1 may be kept constant. However, if the width of the electrode row 2 is smaller than the width of the steel strip 1, problems (4) to (7) with the conventional adjustment method cannot be solved. This method especially suffers from the fatal disadvantage of low use efficiency of the electrodes.

Thickness $t_w$ (in mm) of the electrode unloaded for treating a steel strip of a given width W (in mm) is given as:

$$t_w = T - W(T-t)/Wmax$$

where T is the thickness (in mm) of an electrode which is loaded anew; t is the width (in mm) of the electrode which is unloaded when the width of the steel strip is Wmax; and Wmax is the maximum width in mm of the steel strip used in the treatment line.

The use efficiency $\alpha_w$ of the electrode is given as:

$$\alpha_w = (T-t_w)/T = (W/Wmax)(T-t)/T$$

(T−t)/T corresponds to the use efficiency of the electrodes when a steel strip of the maximum thickness is used. (T−t)/T is thus the maximum use efficiency αmax. Therefore, $$\alpha_w = W/Wmax \cdot \alpha max$$

On the other hand, the minimum use efficiency αmin is given as:

$$\alpha min = Wmin/Wmax \cdot \alpha max$$

where Wmin is the minimum width of the steel strip to be used in the treatment line.

In the case of tin plating wherein there is only a small difference between the maximum width and the minimum width of the strip, the minimum use efficiency does not become very low. However, in the case of zinc plating of a steel plate having a maximum width of 1,819 to 1,219 mm and a minimum width of 900 to 610 mm, the minimum use efficiency decreases to ½ to ⅓ the maximum use efficiency. According to the electrode transfer method described above, the unloaded electrode of greatest thickness is smaller than the thickness of the electrode which is loaded anew, the used electrodes may not be used again and all of them must be disposed of. This results in a low use efficiency.

As an improvement over the method shown in FIGS. 8A and 8B, a method is proposed which is adopted in the radial type apparatus. According to this method, as shown in FIG. 9, the width of the electrode row 2 is made greater than the strip width and the edge mask 9 is used. Although problems (4) to (7) of the conventional adjustment method are solved, problem (5), that is, the decrease in the use efficiency of the electrodes, and the fact that the electrodes cannot be used again, is not solved. Furthermore, as shown in FIG. 9, the electrodes 8 which are not opposed to the steel strip 1 are in the stepped form. Therefore, it is impossible to arrange the edge masks 9 as shown in FIG. 9 and then to displace them to the right or left in accordance with the shift of the steel strip 1.

SUMMARY OF THE INVENTION

It is object of the present invention to provide a method for electroplating a steel strip, which solves the problems as described above.

According to the present invention, there is provided a method for electroplating a steel strip by arranging a plurality of electrode rows each consisting of a plurality of electrodes disposed adjacent to each other along the direction of width of said steel strip in opposition to said strip travelling in an electrolytic cell holding an electrolytic solution, so that a metal constituting said electrodes may be electroplated on said steel strip, comprising the steps of intermittently or continuously transferring said electrodes of said electrode rows in a direction perpendicularly to the direction of travel of said steel strip at a speed so that a distribution of a deposition amount of the metal of said electrodes along the direction of width of said steel strip may be kept within an allowable tolerance, a width of said electrode rows being greater than the width of said steel strip; and loading said electrode from one of one of said electrode rows transferred by said transferring step and unloading said electrode to the other end of said one electrode row or to an end of another of said electrode rows.

DETAILED DESCRIPTION OF THE PREFERRED EMBODIMENTS

The preferred embodiments of the present invention will now be described with reference to the accompanying drawings.

Figure 1A:
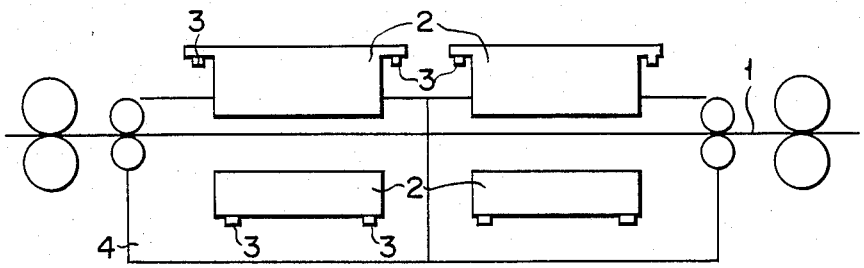
FIG. 1A (PRIOR ART)
FIG. 1A is a front view of a conventional parallel type electroplating apparatus.
Figure 1B:
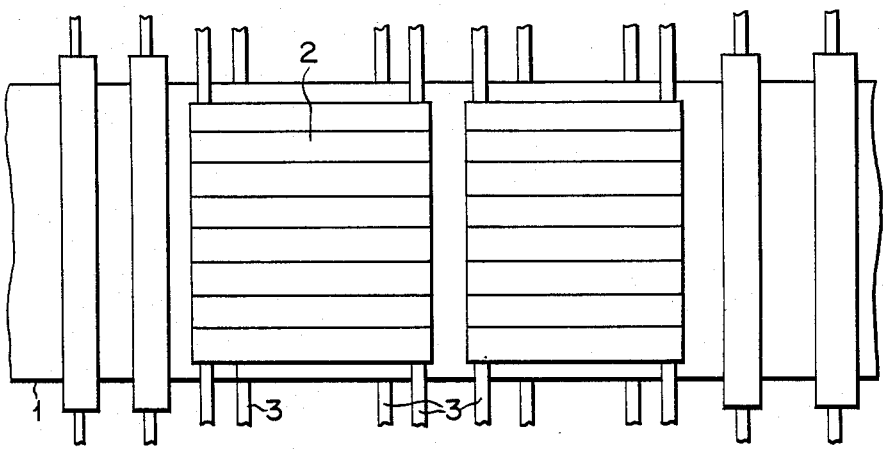
FIG. 1B (PRIOR ART)
FIG. 1B is a plan view of the apparatus shown in FIG. 1.
Figure 2:
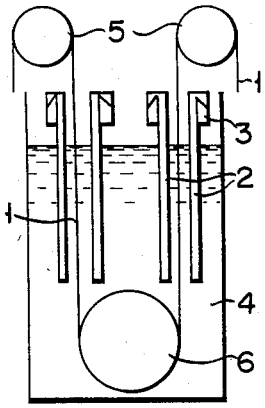
FIG. 2 (PRIOR ART)
FIG. 2 is a front view of a conventional vertical type electroplating apparatus.
Figure 3:
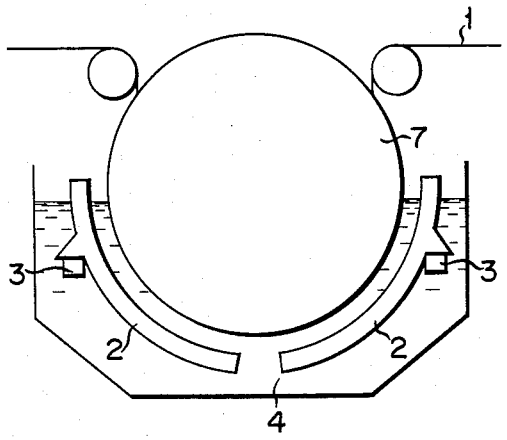
FIG. 3 (PRIOR ART)
FIG. 3 is a front view of a conventional radial type electroplating apparatus.
Figure 4A:
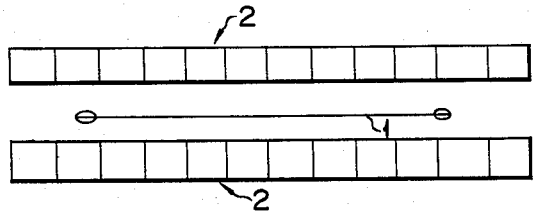
FIG. 4A (PRIOR ART)
FIGS. 4A and 4B are views for explanation of problems with the conventional electroplating method.
Figure 4B:
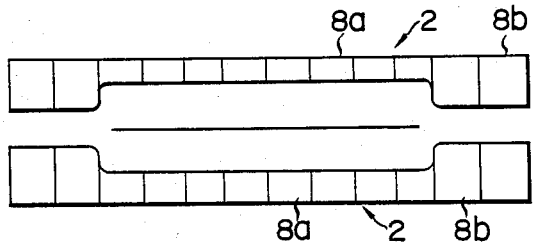
FIG. 4B (PRIOR ART)
Figure 5:
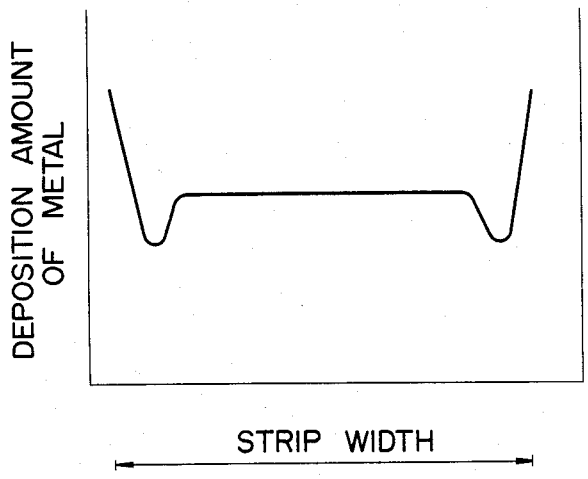
FIG. 5 (PRIOR ART)
FIG. 5 is a graph showing the relationship between the strip width and the deposition amount of the metal according to the conventional electroplating method.
Figure 6:
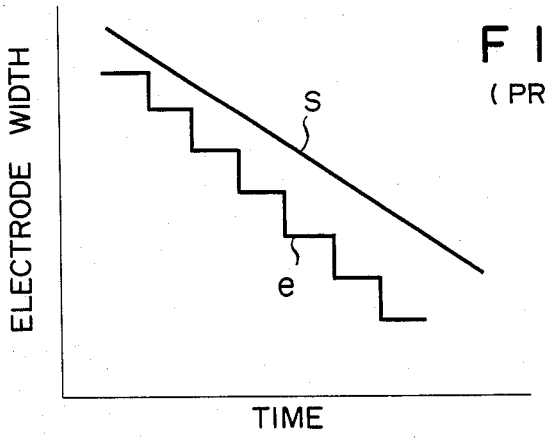
FIG. 6 (PRIOR ART)
FIGS. 6 and 7 are views for explanation of problems with the conventional method for adjusting the width of the electrode row.
Figure 7:
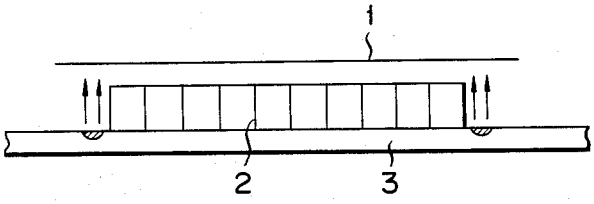
FIG. 7 (PRIOR ART)
Figure 8A:
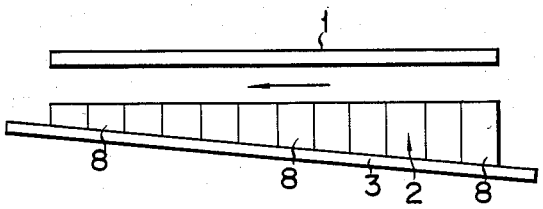
FIG. 8A (PRIOR ART)
FIGS. 8A, 8B and 9 are views for explanation of conventional, improved electroplating methods.
Figure 8B:
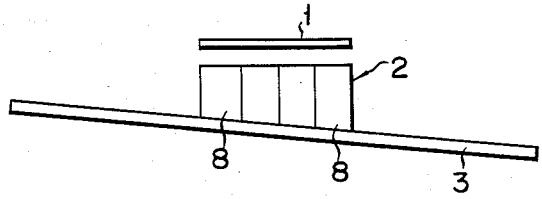
FIG. 8B (PRIOR ART)
Figure 9:
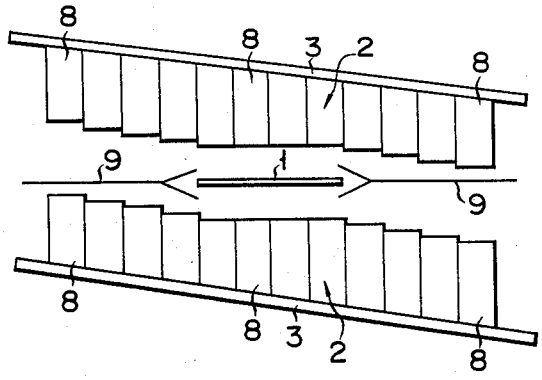
FIG. 9 (PRIOR ART)
Figure 10:
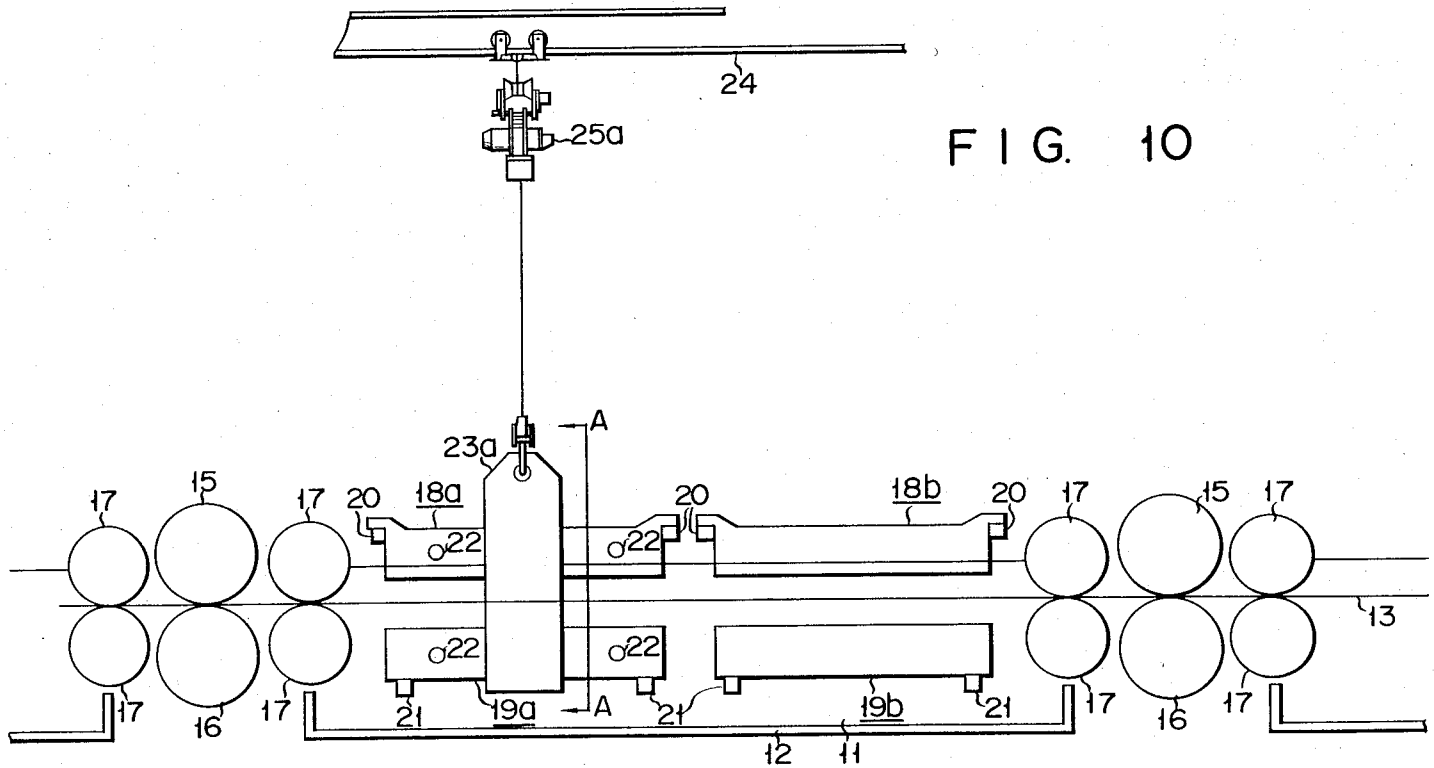
FIG. 10 is a front view showing an apparatus which is used in an electroplating method according to an embodiment of the present invention.
Figure 11:
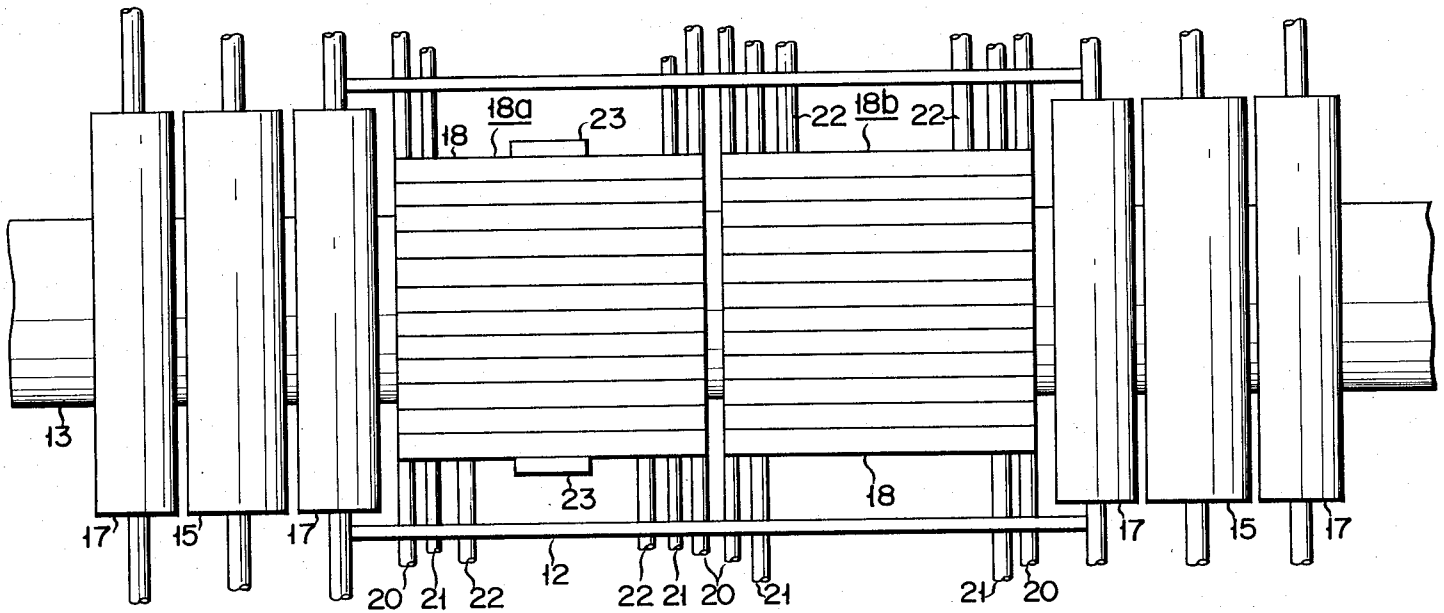
FIG. 11 is a plan view of the apparatus shown in FIG. 10.
Figure 12:
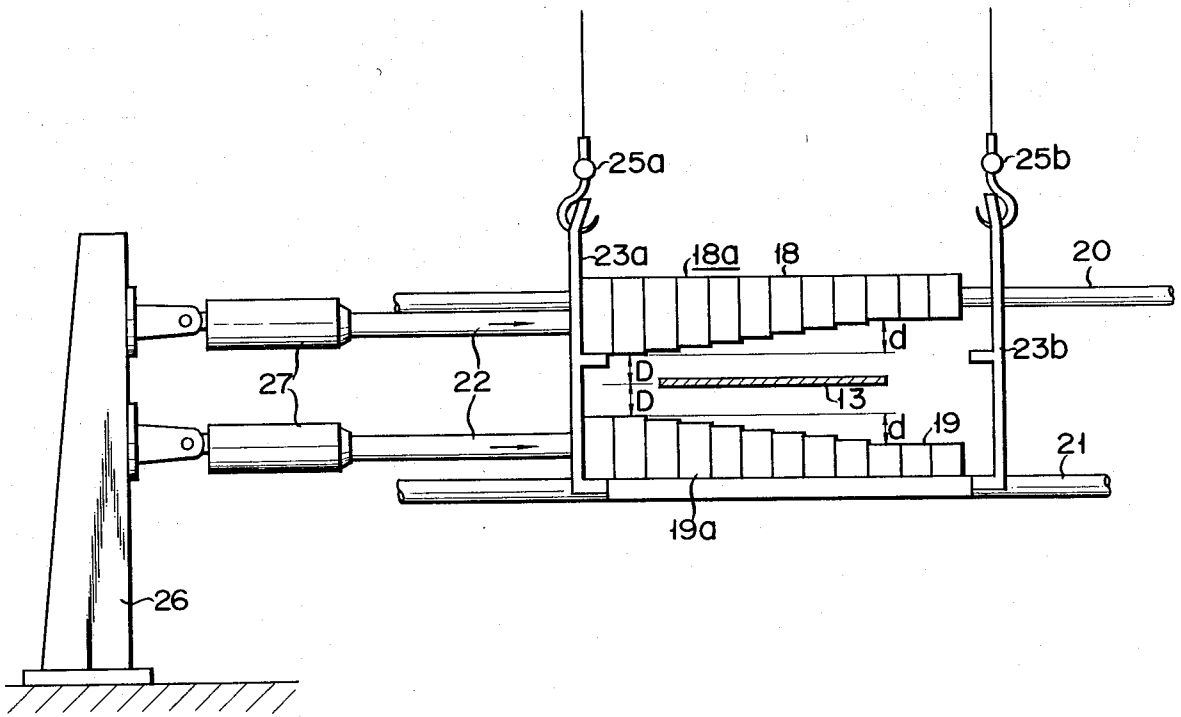
FIG. 12 is a sectional view of the apparatus shown in FIG. 10 along the line A—A thereof.

FIG. 10 is a front view showing an example of an electroplating apparatus used for practicing the method according to the present invention. FIG. 11 is a plan view of FIG. 10 while FIG. 12 is a sectional view along the line A—A of FIG. 10. In this apparatus, a steel strip 13 is made to pass through an electrolytic cell 12 holding an electrolytic solution 11. The steel strip 13 is electroplated using soluble anodes. The steel strip 13 is horizontally transferred by a conductor roll 15, a back-up roll 16, and dam rolls 17. Upper electrode rows 18*a* and 18*b*, and lower electrode rows 19*a* and 19*b* are arranged along the direction of travel of the steel strip 13 to be in opposition with the upper and lower surfaces, respectively, of the steel strip 13 travelling in the electrolytic cell 12. The upper and lower electrode rows 18*a*, 18*b*, 19*a* and 19*b* consist of a plurality of electrodes 18 and 19 which are arranged perpendicularly to the direction of travel of the steel strip 13, and define a soluble anode system. These electrode rows 18*a* and 18*b* are electrically connected to upper busbars 20, while the lower electrode rows 19*a* and 19*b* are electrically connected to lower busbars 21. Push rods 22 are arranged at one side surface of the upper and lower electrode rows for moving them. The push rods 22 are mounted to hydraulic cylinders 27 supported by a frame 26. An electrode-loading carrier 23*a* and an electrode-unloading carrier 23*b* are arranged at the respective side surfaces of each of upper and lower electrode rows. These carriers 23*a* and 23*b* are suspended from hoists 25*a* and 25*b* which are travelling on two rails 24 (only one shown in FIG. 10).

In order to practice the method of the present invention, as shown in FIGS. 11 and 12, a number of electrodes are arranged on the busbars 20 and 21 so that the width of the upper and lower electrode rows 18 and 19 may be greater than the width of the steel strip 13. Upon operation of the hydraulic cylinders 27, the push rods 22 urge the side surfaces of the electrodes 18 and 19. Then, the electrodes are moved in the direction which is substantially perpendicular to the running direction of the steel strip 13. Thus, the electrodes are sequentially unloaded from one end of the electrode rows and are loaded on the other end of the same electrode rows or to the ends of other electrode rows. The transfer of the electrodes may be performed by a belt conveyor or the like in place of the hydraulic cylinders 27 and the push rods 22. Busbars 20 and 21 may also be transferred or moved to transfer the electrodes arranged on the busbars.

According to the method of the present invention, the transfer of the electrodes is performed intermittently or continuously at a speed so that the distribution of the deposition amount of the metal in the direction of width of the steel strip 13 may fall within a predetermined range. More specifically, the transfer speed v (m/hr) is within the range defined by relations (1) and (2) below:

$$v \geqq [60 \cdot E \cdot D_A \cdot W(100-2A)]/(20 \cdot A \cdot \rho \cdot DB \cdot D) \quad (1)$$

$$v \geqq [60 \cdot E \cdot D_A \cdot W(1-\sqrt{2A/100})]/(20 \cdot \sqrt{2A/100} \cdot \rho \cdot K \cdot D) \quad (2)$$

where $\rho$ is the density of deposited metal (g/cm$^3$); K, the electroplating constant of the metal (A·min/g); D, the distance between the steel strip and the electrode end at the loading side of the electrode row (mm); A, the allowable tolerance of the deposition amount in the direction of width of the steel strip (%); E, the electrolytic efficiency; $D_A$, the current density (A/dm$^2$); and W, the width of the steel strip (m).

Figure 13:
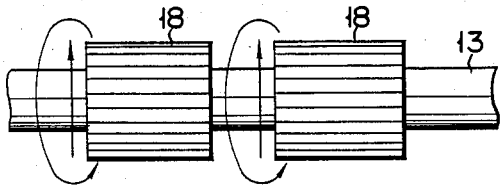
FIGS. 13 to 15 are views showing the methods for unloading and loading the electrodes according to the present invention.

Relation (1) as given above is applicable to the case as shown in FIG. 13 wherein the transfer direction (indicated by the solid arrow) is the same for all electrode rows.

Figure 14:
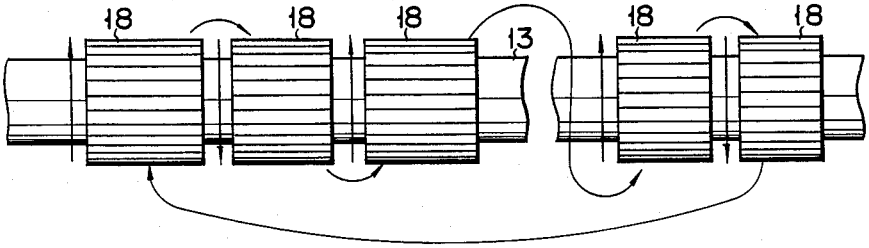
Figure 15:
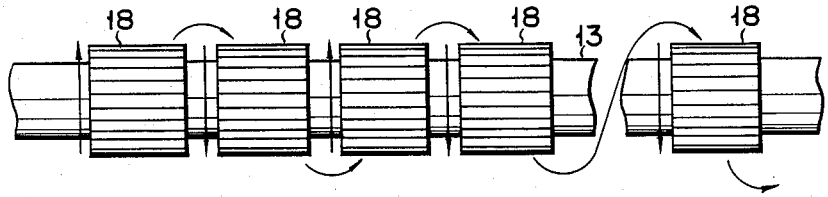

On the other hand, relation (1) as given above is applicable to the case shown in FIGS. 14 and 15 wherein the transfer direction (indicated by the solid arrow) alternately becomes opposite. FIG. 14 shows a case wherein the electrode unloaded from the last electrode row is loaded to the first electrode row. FIG. 15 shows a case wherein the electrode unloaded from the last electrode row has reached a thickness which allows no further use and must be disposed.

Relations (1) and (2) above are obtained in the manner to be described below.

The amount of metal consumed per hour Ch (g/hr) in the electroplating process of the steel strip is given as:

$$Ch = C \cdot W \cdot S \cdot 60 \quad (3)$$

where C is the deposition amount of the metal per square meter of one surface of the steel strip (g/m$^2$); S, the running speed of the steel strip (m/min); and W, the width of the steel strip. The volume of the metal consumed per hour V (cm$^3$/hr) is expressed by relation (4) below:

$$V = Ch/\rho \quad (4)$$

where $\rho$ is the density of the metal (g/cm$^3$).

The surface area $S_A$ (cm$^2$) of one surface of the electrode is expressed by relation (5) below:

$$S_A = W \cdot L \cdot 10^4 \quad (5)$$

where L is the length of the electrode (m).

The running speed S of the steel strip is expressed by relation (6) below:

$$S = (L \cdot DA)/(K/E \cdot C) \cdot 10^2 \quad (6)$$

where E is the electrolytic efficiency and K is the electroplating constant (A·min/g).

The parameter K denotes the electroplating constant of the metal (A·min/g) and can be obtained by 60/Z, where Z is the electrochemical equivalent (g/A·hr) and represents the theoretical deposition amount of an optional material achieved by a quantity of electricity of 1 A hr. In the case of zinc, z is 1.22 g/A·hr and, thus, K is 49.18 A·min/g. The parameter E denotes the electrolytic efficiency, which is the ratio of the theoretical quantity of electricity to the actually required quantity of electricity, i.e., theoretical quantity/actually required quantity. According to Faraday's law, 1 g equivalent of material can be deposited by a constant quantity of electricity. However, the constant quantity mentioned is a theoretical quantity. The actually required quantity is greater than the theoretical quantity because of the loss of electricity in undesired discharge, secondary reaction around the electrodes, current leakage, short circuiting and conversion of current into heat.

From relations (3) to (6) given above, the reduction in the thickness of the electrode Ti (cm/hr) is expressed by relation (7) below:

$$Ti = V/S_A = (C \cdot W \cdot S \cdot 60)/(\rho \cdot W \cdot L \cdot 10^4) \quad (7)$$

$$= (E \cdot 60 \cdot D_A)/(\rho \cdot K \cdot 10^2)$$

Let v denote the transfer speed in m/hr of the electrode, and the difference d (mm) between the thickness of the unloaded electrode and the newly loaded electrode is given by relation (8) below:

$$d = Ti \cdot W/v \cdot 10 \quad (8)$$

$$= (E \cdot 60 \cdot D_A \cdot W)/(\rho \cdot K \cdot v \cdot 10)$$

Therefore, $$v=(E \cdot 60 \cdot D_A \cdot W)/(\rho \cdot K \cdot d \cdot 10) \quad (9)$$

The difference d between the thicknesses of the electrodes and the deposition amount of the metal in the direction of width of the steel strip were found to hold relations (10) and (11) below from the experiments:

$$(C_1-C_2)/C_1=d/(D+d) \quad (10)$$

$$(C_1-C_c)/C_1=[d/(2_D+d)]^2 \quad (11)$$

where $C_1$ is the metal deposition amount (g/m$^2$) on the steel strip at the electrode loading side; $C_2$, the metal deposition amount (g/m$^2$) on the steel strip at the electrode unloading side; $C_c$, the metal deposition amount (g/m$^2$) on the central portion of the steep strip along the direction of width thereof; and D, the distance (mm) between the electrode and the steel strip at the electrode loading side.

Figure 17:
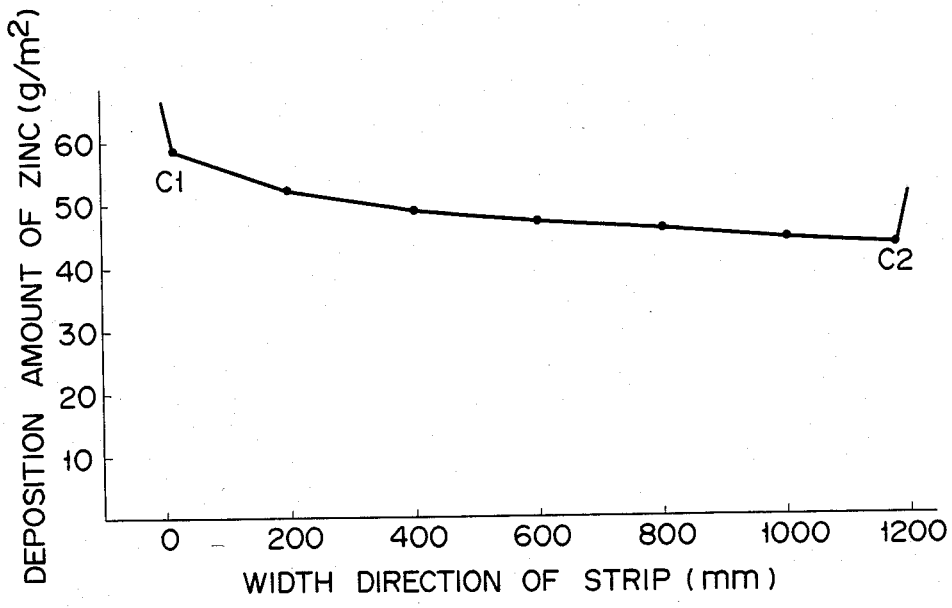
FIGS. 17 and 18 are graphs showing the results obtained in the experiment shown in FIG. 16.

Relation (10) given above was obtained by varying the average current density $D_A$, the distance D between the steel strip and the electrode, the difference d between the thicknesses of the electrodes, and the width W of the steel strip, in a plating bath which held zinc sulfate and in which were arranged a steel strip 13 and zinc electrodes 18. FIG. 17 shows an example of the deposition amount distribution of zinc when $D_A$=60A/dm$^2$, D=25 mm, d=10 mm, and W=1,200 mm.

Figure 16:
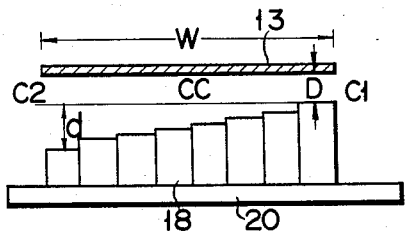
FIG. 16 shows the positional relationship between the steel strip and the electrodes in an experiment conducted according to the present invention.
Figure 18:
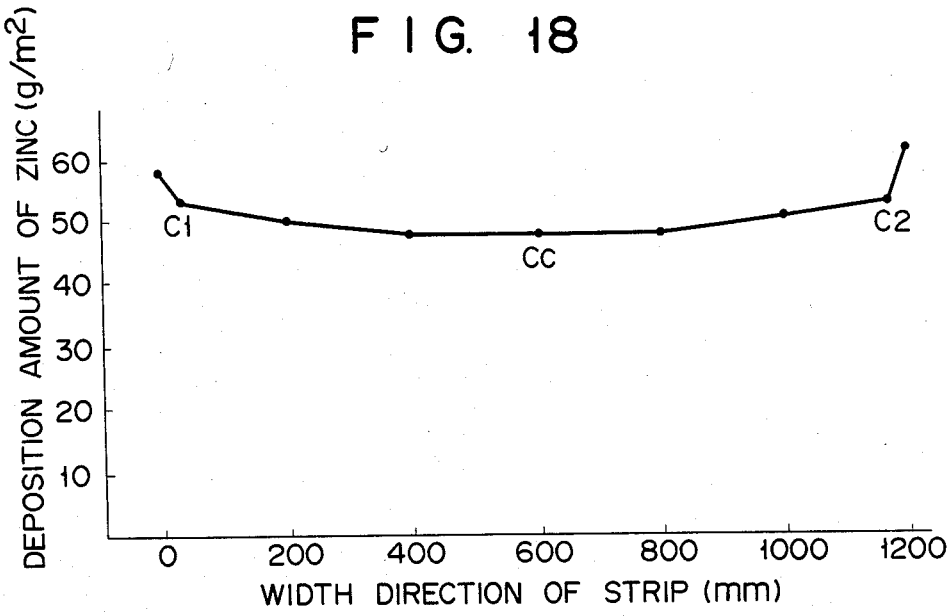

Relation (11) above was obtained when electroplating was performed under various conditions with the right and left sides of the steel strip reversed after performing electroplating with the arrangement of the steel strip 13 and the zinc electrodes 18 shown in FIG. 16. FIG. 18 shows an example of the deposition amount distribution of zinc when electroplating was performed for 12.5 seconds under the conditions of $D_A$=60A/dm$^2$, D=25 mm, d=25 mm, and W=1,200 mm, and when electroplating was performed again for another 12.5 seconds with the right and left sides of the steel strip reversed.

If the allowable tolerance of the deposition amount is represented by ±A (%), the transfer speed of the electrodes which allows electroplating with the deposition amount falling within the allowable tolerance may be obtained by relations (1) or (2) from relations (9) and (10) or from relations (9) and (11).

If the transfer direction of the electrode is the same for all electrode rows as shown in FIG. 13, from relation (10), we obtain:

$$2A/100 \geqq (C_1-C_2)/C_1=d(D+d)$$

$$d \leqq [2A/(100-2A)] \cdot D \quad (12)$$

From relations (9) and (12), we obtain:

$$v \geqq [E \cdot 60 \cdot D_A \cdot W(100-2A)]/(\rho \cdot K \cdot D \cdot 2A \cdot 10) \quad (1)$$

If the transfer direction of the electrode alternatively becomes opposite for the respective electrode rows as shown in FIGS. 14 and 15, we obtain from relation (11):

$$2A/100 \geqq (C_1-C_c)/C_1=[d/(2D+d)]^2$$

$$d \leqq (2D\sqrt{2A/100})/(1-\sqrt{2A/100}) \quad (13)$$

From relations (9) and (13), we obtain:

$$v \geqq [E \cdot 60 \cdot D_A \cdot W \cdot (1-\sqrt{24/100})]/[p \cdot K \cdot D \cdot 2\sqrt{2A/100} \cdot 10] \quad (14)$$

According to the method of the present invention, the electrodes are transferred at a transfer speed which satisfies relation (1) or (2). The electroplating is performed under this condition, and the unloaded electrodes are repeatedly loaded on the same or other electrode rows until their thickness reaches a predetermined value. This is because the difference d between the thickness of the loaded electrode and that of the unloaded electrode is extremely small as may be seen from relations (10) and (11) above, and the unloaded electrode may be directly used as the electrode to be newly loaded without any problem.

In the embodiment described above, the electrodes are arranged to oppose both surfaces of the steel strip. However, the electrodes may be arranged to oppose only one surface of the steel strip.

The present invention will now be described by way of examples.

EXAMPLE 1

Figure 19:
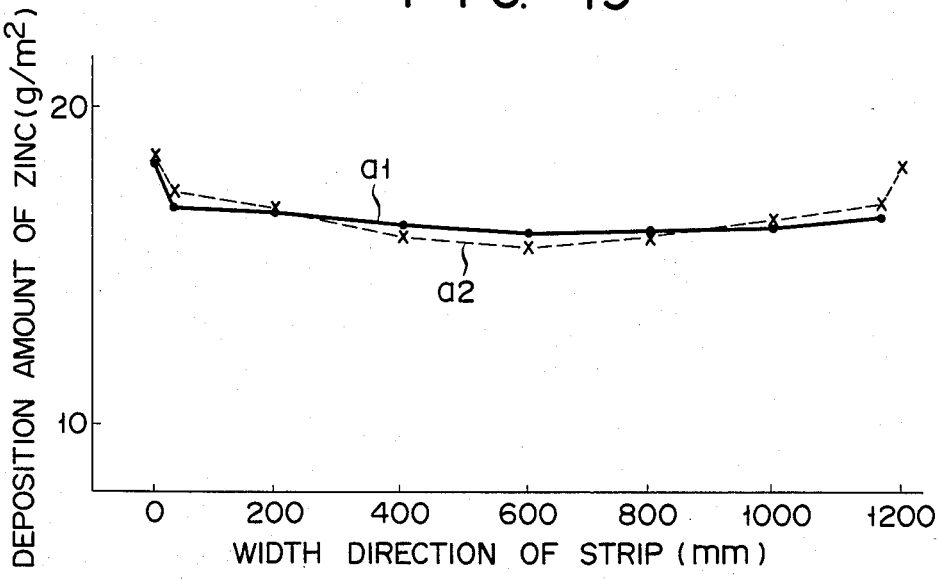
FIGS. 19 and 20 are graphs showing the distribution of the deposition amount of zinc in the experiment according to the present invention.

Using the apparatus shown in FIG. 10, the electrode row had a length of 700 mm and a width of 1,500 mm. Twelve such electrode rows were arranged along the running direction of the steel strip and were plated with zinc in a zinc sulfate bath. The obtained result is shown in FIG. 19. The electrode transfer conditions and the running conditions of the steel strip were: W=1,200 mm, S=60 m/min, D=25 mm, and $D_A$=60 A/dm$^2$. In order to obtain the deposition amount with the allowable tolerance A≦±15%, v must be equal to or larger than 20 mm/hr. In FIG. 19, line $a_1$ corresponds to the case when v=100 mm/hr, and line $a_2$ corresponds to the case when v=50 mm/hr.

It is seen from FIG. 19 that the deposition amount within the allowable tolerance may be obtained according to the present invention.

EXAMPLE 2

Figure 20:
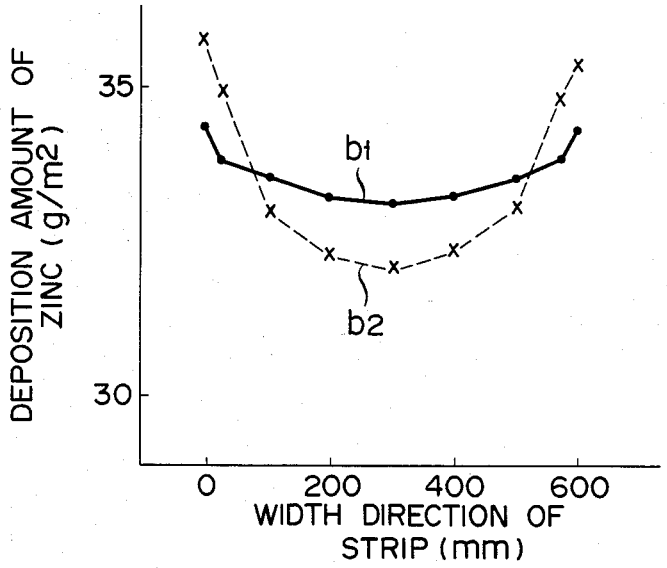

Electroplating was performed in the similar manner to that in Example 1 except that W=600 mm, S=50 m/min, D=30 mm, and $D_A$=100 A/dm$^2$. The obtained result is shown in FIG. 20. In this case, in order to obtain the deposition amount within the allowable tolerance A, equal to or less than 15%, v must be equal to or greater than 14 mm/hr. In FIG. 20, line $b_1$ corresponds to the case when v=100 mm/hr, and line $b_2$ corresponds to the case when v=50 mm/hr.

As may be seen from FIG. 20, the deposition amount within the allowable tolerance may be obtained according to the present invention.

Thus, according to the present invention, by making the width of the electrode row greater than the width of the steel strip, the position from which the electrode is unloaded or through which the electrode is loaded may be set at a position outside the steel strip and rolls. In this manner, the unloading or loading operation becomes extremely easy. Furthermore, since the unloading or loading operation may be performed without stopping the treatment line, the working efficiency is improved. Since the busbars are all covered by the electrodes, they are not subjected to corrosion. For this reason, a chloride bath may be used which allows easy conduction of electricity while it may allow easy corrosion of busbars. Since the electrodes are transferred at more than a predetermined speed, the consumed amount of the unloaded electrodes is small and the unloaded electrodes may be loaded again. Consequently, the use efficiency may be improved and the deposition amount distribution may be kept to fall within a predetermined range.

What we claim is:

1. A method of electroplating movable steel strips of different widths by arranging a plurality of electrode rows in an electrolytic cell containing an electrolytic solution, each of said electrode rows having a first end and a second end and comprising a plurality of metal electrodes disposed adjacent to each other along the direction of the width of said steel strips in opposed relationship to the direction of travel of said steel strips, the width of said electrode rows being greater than the width of said steel strips, and conducting an electrical current through the electrolytic solution in an amount sufficient to electroplate the metal of said metal electrodes on a steel strip having a first width and subsequently electroplating the metal of said metal electrodes on a steel strip having a second width different from said first width, and while electroplating said steel strips of different widths:

intermittently or continuously advancing said metal electrodes of said electrode rows in the same direction, said direction being perpendicular to the direction of travel of said steel strips and said advancing being at a speed whereat the distribution of the amount of the metal of said electrodes which is electroplated in the direction of the width of said steel strips is kept within an allowable tolerance; and transferring one of said metal electrodes from the first end of one of said advance electrode rows to the second end of one of said advanced electrode rows;

said speed v (m/hr) of advancing said electrodes of said electrode rows satisfying the relation:

$$v \geqq [60 \cdot E \cdot D_A \cdot W(100-2A)]/(20 \cdot A \cdot \rho \cdot K \cdot D/)$$

wherein $\rho$ is the density of the electroplated metal ($g/cm^3$); K is the electroplating constant of the metal (A·min/g); D is the distance between the steel strip being plated and the second end of said electrode row (mm); A is the allowable tolerance of the electroplated amount in the direction of the width of the steel strip being plated (%); E is the electrolytic efficiency; $D_A$ is the current density ($A/dm^2$); and W is the width of the steel strip being plated (m).

2. The method of claim 1, wherein a plurality of pairs of said electrode rows are arranged so that the two members of each pair of said plurality of pairs of said electrode rows are respectively arranged to oppose both surfaces of said steel strip.

3. A method of electroplating movable steel strips of different widths by arranging a plurality of electrode rows in an electrolytic cell containing an electrolytic solution, each of said electrode rows having a first end and a second end and comprising a plurality of metal electrodes disposed adjacent to each other along the direction of the width of said steel strips in opposed relationship to the direction of travel of said steel strips, the width of said electrode rows being greater than the width of said steel strip; and conducting an electrical current through the electrolytic solution in an amount sufficient to electroplate the metal of said metal electrodes on a steel strip, having a first width and subsequently electroplating the metal of said metal electrodes on a steel strip having a second width different from said first width and while electroplating said steel strips of different widths:

intermittently or continuously advancing said metal electrodes of said electrode rows in a direction perpendicularly to the direction of travel of said steel strips at a speed whereat the distribution of the amount of the metal of said metal electrodes which is electroplated in the direction of the width of said steel strips is kept within an allowable tolerance, the direction of advancement of one of said electrode rows being opposite to the direction of advancement of adjacent electrode rows; and transferring one of said metal electrodes from the first end of one of said advanced electrode rows to the second end of one of said advanced electrode rows;

said v (m/hr) of advancing said electrodes of said electrode rows satisfying the relation:

$$v \geqq [60 \cdot E \cdot D_A \cdot W(1-\sqrt{2A/100})/(20 \cdot \sqrt{2A/100} \cdot \rho \cdot K \cdot D/)$$

wherein $\rho$ is the density of electroplated metal ($g/cm^3$); K is an electroplating constant of the metal (A·min/g); D is the distance between the steel strip being plated and the second end of said electrode row (mm); A is the allowable tolerance of the electroplated amount in the direction of the width of the steel strip being plated (%); E is the electrolytic efficiency; $D_A$ is the current density ($A/dm^2$); and W is the width of the steel strip being plated (m).

4. The method of claims 1 or 3, wherein the step of conducting an electric current through the electrolytic solution further comprises electrically connecting said electrode rows to busbars connected to a power source and supplying an electric current from said power source to said electrode rows through said busbars.

5. The method of claims 1 or 3, wherein said step of advancing said electrodes comprises pushing said electrode rows by push rods which are arranged at the sides of said electrode rows.

6. The method of claims 1 or 3, wherein the amount of metal electroplated on the steel strip is substantially the same along the width of said steel strip.

7. The method of claim 1 or 3, wherein said transferring step comprises transferring said one metal electrode from said first end of said one advanced electrode row to the second end of the same one advanced electrode row.

8. The method of claim 1 or 3, wherein said transferring step comprises transferring said one metal electrode from said first end of said one advanced electrode row to the second end of a different one of said advanced electrode rows.

9. The method of claim 1 or 3 wherein electroplating of said moveable steel strip is performed by placing said electrode rows on busbars connected to a power source and energizing said electrode rows.

10. The method of claim 9 wherein the step of transferring said electrodes comprises moving the busbars having said electrodes arranged thereon.

11. The method of claim 3, wherein a plurality of pairs of said electrode rows are arranged so that the two members of each pair of said plurality of pairs of said electrode rows are respectively arranged to oppose both surfaces of said steel strip.

* * * * *